US010641054B2

(12) United States Patent
Sommer

(10) Patent No.: US 10,641,054 B2
(45) Date of Patent: May 5, 2020

(54) RETRIEVAL SYSTEM

(71) Applicant: Welltec A/S, Allerød (DK)

(72) Inventor: Rasmus Sommer, Allerød (DK)

(73) Assignee: Welltec A/S, Allerød (DK)

( * ) Notice: Subject to any disclaimer, the term of this patent is extended or adjusted under 35 U.S.C. 154(b) by 3 days.

(21) Appl. No.: 16/043,202

(22) Filed: Jul. 24, 2018

(65) Prior Publication Data

US 2019/0032432 A1 Jan. 31, 2019

(30) Foreign Application Priority Data

Jul. 25, 2017 (EP) ..... 17183075

(51) Int. Cl.
*E21B 23/00* (2006.01)
*E21B 31/18* (2006.01)
*E21B 23/01* (2006.01)

(52) U.S. Cl.
CPC ..... *E21B 23/00* (2013.01); *E21B 23/01* (2013.01); *E21B 31/18* (2013.01)

(58) Field of Classification Search
CPC ..... E21B 31/12; E21B 23/00; E21B 23/01
See application file for complete search history.

(56) References Cited

U.S. PATENT DOCUMENTS 2,245,571 A * 6/1941 Chappell ..... E21B 23/06 294/86.18
2014/0138969 A1 5/2014 Guidry et al.

FOREIGN PATENT DOCUMENTS

CN 201 031 643 3/2008
EP 2 599 952 6/2013
EP 2 924 230 9/2015

OTHER PUBLICATIONS

Extended EP Search Report for 17183075.5 dated Jan. 30, 2018, 8 pages.

* cited by examiner

*Primary Examiner* — David J Bagnell
*Assistant Examiner* — Dany E Akakpo
(74) *Attorney, Agent, or Firm* — Nixon & Vanderhye P.C.

(57) ABSTRACT

The present invention relates to a retrieval system for retrieving a well component, such as a plug, from a well tubular metal structure having a restriction and a top, said retrieval system comprising a tool string having a longitudinal extension and comprising a connection tool configured to connect with the well component, a force generator having a first part and a second part which is connectable with the connection tool and movable in relation to the first part for providing the axial force in the longitudinal extension, an anchoring section having at least one projectable element for anchoring the tool string, wherein the retrieval system further comprises a safety unit surrounding the tool string and having at least one wall and at least one abutment face configured to abut the restriction, said at least one projectable element abutting. Furthermore, the present invention relates to a downhole system and to a downhole well component retrieval method.

17 Claims, 3 Drawing Sheets

RETRIEVAL SYSTEM

Figure 1:
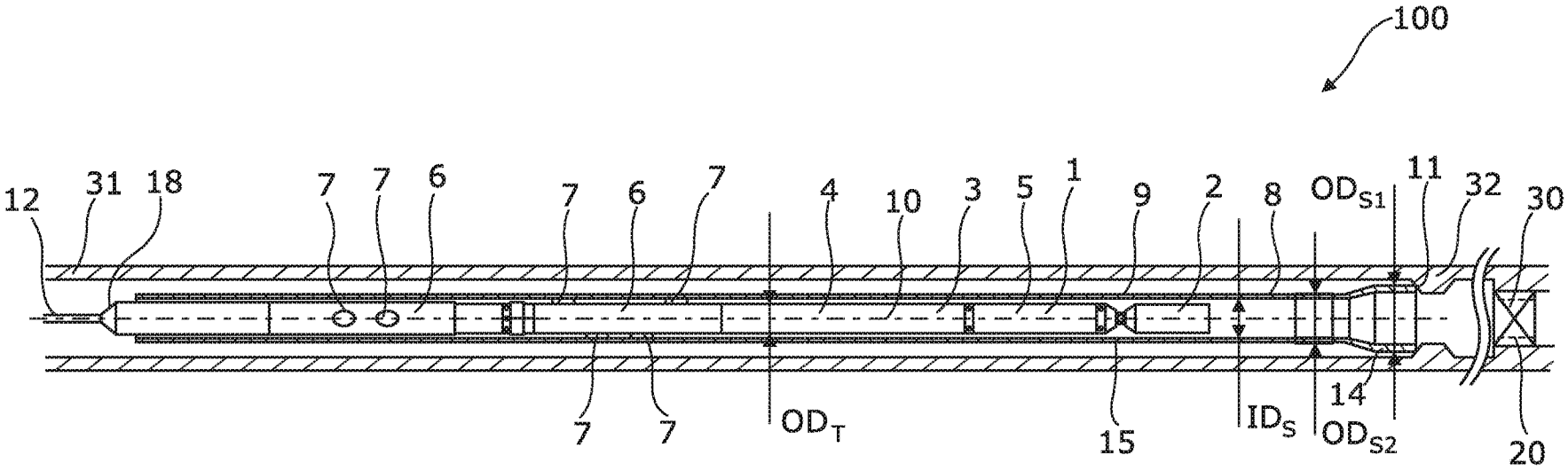

This application claims priority to EP Patent Application No. 17183075.5 filed 25 Jul. 2017, the entire contents of which is hereby incorporated by reference.

The present invention relates to a retrieval system for retrieving a well component, such as a plug, from a well tubular metal structure. Furthermore, the present invention relates to a downhole system and to a downhole well component retrieval method.

When pulling a plug, such as a crown plug, in the top of an oil well, an intervention tool is submerged into the well and docks in a restriction which is situated at a known distance from the plug to be retrieved. Then the intervention tool axially displaces a GS pulling tool or similar connection tool, which latches into the plug, and subsequently the plug is pulled by retracting the connection tool in an upwards direction. However, in the event that the plug is stuck, the intervention tool is also stuck between the plug and the restriction, and the normal last way of disconnecting the tool by hammering onto the top end of the tool does not work due to the fact that the tool cannot move downwards because of the restriction.

It is an object of the present invention to wholly or partly overcome the above disadvantages and drawbacks of the prior art. More specifically, it is an object to provide an improved retrieval system which is able to be released even though the intervention tool is stuck inside the plug.

The above objects, together with numerous other objects, advantages and features, which will become evident from the below description, are accomplished by a solution in accordance with the present invention by a retrieval system for retrieving a well component, such as a plug, from a well tubular metal structure having a restriction and a top, said retrieval system comprising:

- a tool string having a longitudinal extension and comprising:
  - a connection tool configured to connect with the well component,
  - a force generator having a first part and a second part which is connectable with the connection tool and movable in relation to the first part for providing the axial force in the longitudinal extension, and
  - an anchoring section having at least one projectable element for anchoring the tool string, wherein the retrieval system further comprises a safety unit surrounding the tool string and having at least one wall and at least one abutment face configured to abut the restriction, said at least one projectable element abutting the wall of the safety unit in order to anchor the tool string in the safety unit.

The tool string may be connected with the top via a wireline.

Additionally, the safety unit may surround the tool string.

Moreover, the safety unit may overlap the tool string when seen in cross-section along the longitudinal direction of the tool string.

Furthermore, the safety unit may project in front of the connection tool and extend beyond the tool string Also, the outer diameter of the part of the safety unit projecting beyond the tool string may be larger than the outer diameter of the tool string.

In addition, the safety unit may overlap the projectable element and project in front of the connection tool and extend beyond the tool string.

Further, the abutment face may extend beyond the tool string.

Moreover, the safety unit may have an inner diameter which is larger than an outer diameter of the tool string.

Also, the safety unit may be a tubular sleeve.

Furthermore, the inner diameter of the safety unit may be less than 30% larger than the outer diameter of the tool, preferably less than 20% larger than the outer diameter of the tool, more preferably less than 10% larger than the outer diameter of the tool.

In addition, the safety unit may have a first unit part and a second unit part, the first unit part may have the abutment face, and the first unit part may have a larger inner diameter than an inner diameter of the second part, the at least one projectable element abutting the wall of the second unit part of the safety unit.

Hereby the projectable part does not have to project radially to as high an extent as if the projectable element had to abut the wall of the first unit part.

The safety unit may have a first unit part and a second unit part, the first unit part may have the abutment face, and the first unit part may have a larger outer diameter than an outer diameter of the second part, the at least one projectable element abutting the wall of the second unit part of the safety unit.

Moreover, the safety unit may be made of metal.

Further, the connection tool may be projectable beyond the abutment face along the longitudinal extension.

Also, the safety unit may have a plurality of arms, each arm having an end face facing away from the top and constituting the abutment face.

Additionally, the anchoring section may have at least two projectable elements arranged in the same cross-sectional plane perpendicular to the longitudinal extension.

Furthermore, the tool string may have a first end face facing the top and upon which end face a force may be applied to slightly move the tool string in relation to the safety unit to release the connection tool from the well component to be able to pull the tool string out of the well without retrieving the well component.

In addition, the tool string may further comprise a cleaning tool configured to eject or suck fluid to clean a profile in the well component.

The cleaning tool may be arranged between the connection tool and the force generator.

Said force generator may be hydraulically driven by a pump driven by a motor which is powered by the wireline.

The present invention further relates to a downhole system comprising:

- a well tubular metal structure in a borehole of a well, the well tubular metal structure comprising a restriction and a plug, and
- a retrieval system according to any of the preceding claims.

The present invention also relates to a downhole well component retrieval method, comprising:

- arranging a tool string of a retrieval system according to the present invention within the safety unit,
- anchoring the tool string inside the safety unit by projecting the projectable element,
- introducing the retrieval system into the well tubular metal structure until the abutment face rests against the restriction,
- moving the second part of the force generator in relation to the first part until the connection tool engages the well component, and
- pulling the well component by retracting the second part of the force generator for retrieving the well component.

Said downhole well component retrieval method according to the present invention may comprise detecting a failure in retrieving the well component, and releasing the connection tool by providing a hammering force at the end face of the tool string.

Figure 2A:
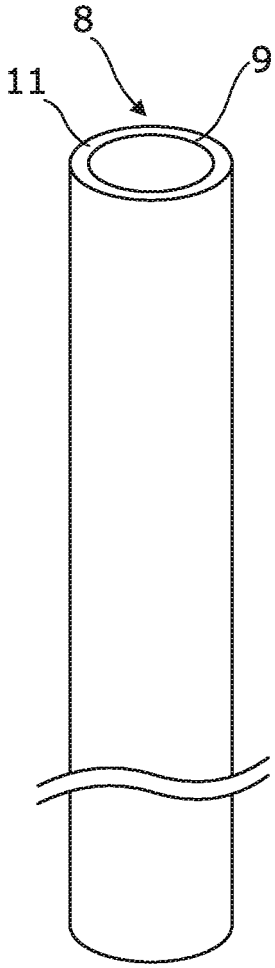
Figure 2B:
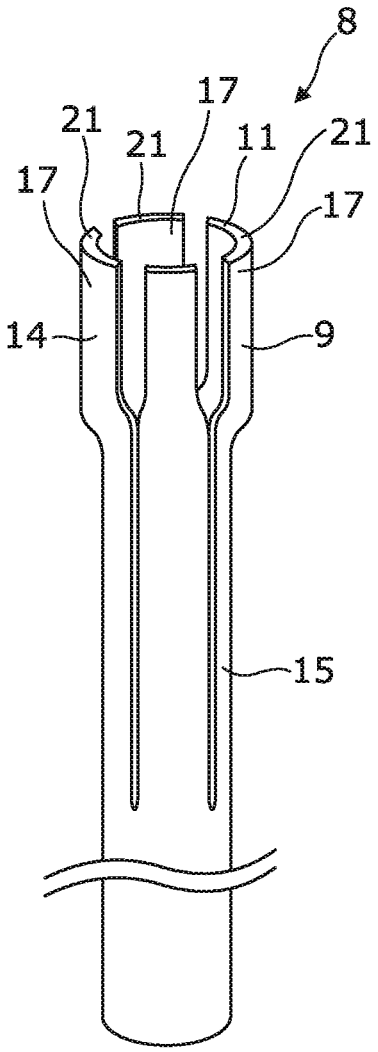
Figure 2C:
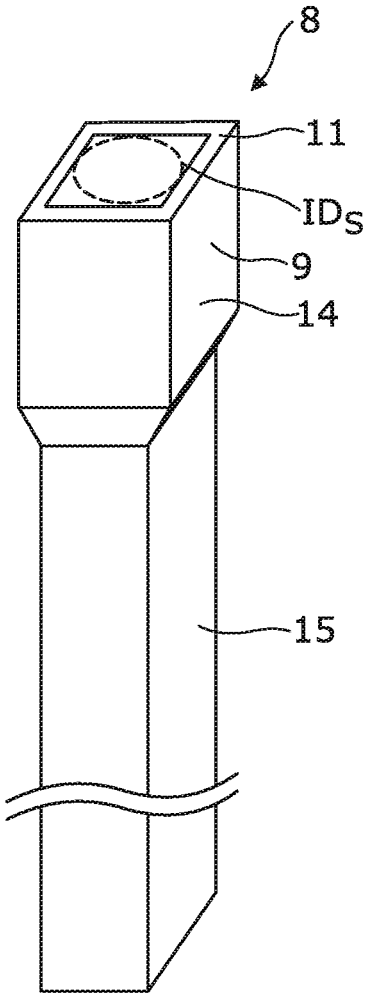
Figures 3, 3A:
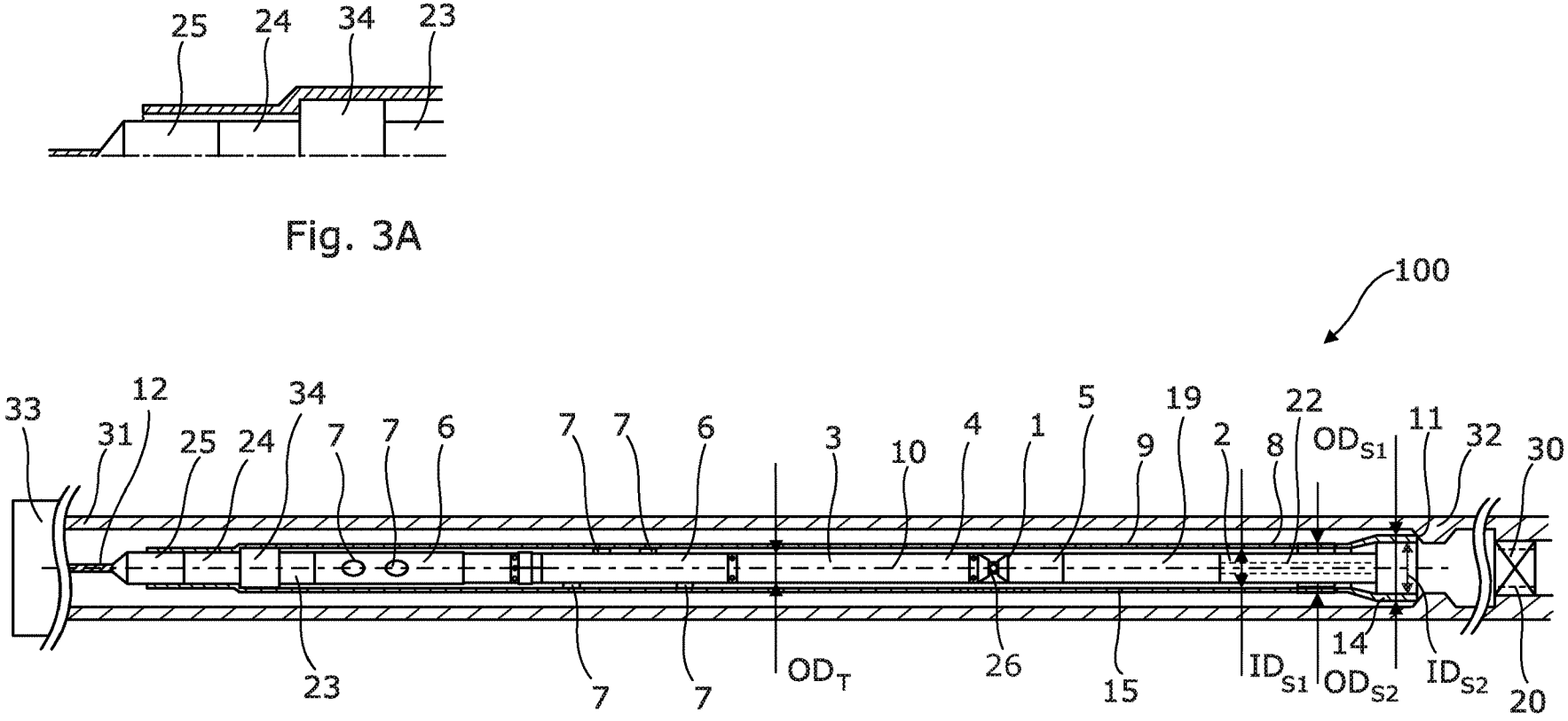

The invention and its many advantages will be described in more detail below with reference to the accompanying schematic drawings, which for the purpose of illustration show some non-limiting embodiments and in which:

FIG. 1 shows a partly cross-sectional view of a retrieval system having a tool string arranged inside a sleeve-shaped safety unit for retrieving a plug, FIGS. 2A-C show different embodiments of the safety unit, FIG. 3 shows a partly cross-sectional view of another retrieval system having a tool string arranged inside a sleeve-shaped safety unit, and FIG. 3A shows a partly cross-sectional view of part of the retrieval system of FIG. 3.

All the figures are highly schematic and not necessarily to scale, and they show only those parts which are necessary in order to elucidate the invention, other parts being omitted or merely suggested.

FIG. 1 shows a retrieval system 100 for retrieving a well component 30, such as a plug, from a well tubular metal structure 31 having a restriction 32 and a top 33 (shown in FIG. 3). The restriction 31 is arranged at a predetermined distance from the well component 30. The retrieval system comprises a tool string 1 having a longitudinal extension 10 and comprising a connection tool 2 configured to connect with the well component. The tool string 1 comprises a force generator 3 for providing the axial force in the longitudinal extension of the well tubular metal structure. The force generator 3 has a first part 4 and a second part 5 and the second part 5 is fastened to the connection tool and movable in relation to the first part when providing the axial force in the longitudinal extension in order to e.g. pull in the plug and retrieve the plug from the well tubular metal structure. The tool string 1 further comprises an anchoring section 6 having several projectable elements 7 for anchoring the tool string while the force generator pulls the plug by retracting the second part 5 towards the stationary first part 4. Thus, when connecting to the plug, the second part of the force generator 3 is moved away from the first part and when connected to the component, i.e. the plug, the second part moves in the opposite direction towards the first part and pulls the plug. The retrieval system further comprises a safety unit 8 surrounding the tool string and having a wall 9 and one abutment face 11 which abuts the restriction 32. The projectable elements abut the wall of the safety unit in order to anchor the tool string 1 inside the safety unit 8. The safety unit 8 is a tubular pipe, such as a tubular sleeve, in which the tool string is arranged and anchors so that the tool string does not anchor directly inside the well tubular metal structure 31. The abutment face 11 of the safety unit 8 abuts the restriction, such as a no-go, and as the second part 5 of the force generator 3 moves away from the first part, the connection tool engages a profile 20 in the plug 30, and as the second part is retracted again, the plug is pulled out of engagement with the well tubular metal structure 31. The connection tool may be any kind of connection tool, such as a GS tool, a setting tool, a fishing tool or an overshot capable of engaging a component in the well.

By having a safety unit 8, the connection tool 2 can be released from the plug even in the event that the plug is stuck in the well tubular metal structure and thus the tool string is stuck. Releasing the connection tool is possible by simply hammering onto the end face 18 of the tool string, and by means of this hammering motion the tool string is hammered slightly downwards inside and in relation to the safety unit which is stationary during the hammering operation. If the retrieval system did not have the safety unit and was anchored directly to the restriction/well tubular metal structure, the tool string could not move in relation to the restriction and would then be stuck as in prior art solutions. Thus, in the present solution, the tool string can move/slide slightly in relation to the restriction towards the plug when a very high force is applied, such as by hammering onto the end face 18 of the tool string as the projectable elements of the anchor section slide along the inner face of the safety unit 8, and thus the tool string is able to move in relation to the restriction. The connection tool 2 is thereby released from the component, i.e. the plug, since by the downwards movement towards and into the plug, a shear pin or similar device in the plug is broken and the connection tool is released from the plug.

The tool string is connected with the top via a wireline 12, which may be a slick-line, e-line or conventional wireline. The tool string is thus a wireline tool string, but may also be connected to surface by other means.

The safety unit 8 has an inner diameter $ID_S$ which is larger than an outer diameter $OD_T$ of the tool string 1. The inner diameter of the safety unit may be less than 30% larger than the outer diameter of the tool, preferably less than 20% larger than the outer diameter of the tool, more preferably less than 10% larger than the outer diameter of the tool. In this way, the projectable elements of the anchoring section 6 are projected at a minimum.

In FIG. 3, the safety unit 8 has a first unit part 14 and a second unit part 15, where the first unit part has the abutment face, and the first unit part has an inner diameter $ID_{S1}$ which is larger than an inner diameter $ID_{S2}$ of the second part, and the projectable element of the anchoring section 6 abuts the wall of the second unit part of the safety unit. Hereby, the projectable elements 7 do not have to project all the way to abut the inner face of the first unit part but only to the smaller second unit part. Thus as shown in FIG. 1, the first unit part 14 has the abutment face 11 and a larger outer diameter $OD_{S1}$ than an outer diameter $OD_{S2}$ of the second part.

Furthermore, by having a safety unit 8, the tool string 1 can fit into well tubular metal structures having different inner diameters just by changing the safety unit 8. Thus, the same tool string can be used to pull a plug in a larger diameter well tubular metal structure just by changing the safety unit 8 to a safety unit having a larger outer diameter in the first unit part 14. Thus, the same tool string can fit both larger and smaller well tubular metal structures just by changing the safety unit having a smaller or larger first unit part 14. The inner and outer diameter of the second unit part of the safety units can be more or less the same.

The safety unit provides a fixed support for the tool string and can easily be changed to change diameter.

In FIG. 3, the tool string 1 comprises a connection unit 34 for fastening the tool string within the safety unit 8 as they are run in. The connection unit fastens the safety unit to the tool string 1 in the axial direction and only in the upwards direction, so when pulling in the wireline, the safety unit 8 is pulled out of the well along with the tool string. This is due to the fact that in the event that the tool string is not able to pull e.g. the plug, the tool string can be released by applying a powerful stroke to the end of the tool string nearest the surface and thus move the tool string slightly downwards to break a shear pin or similar to release the tool string from the plug. The connection unit 34 may be an expandable or a fixed part, such as a no-go mounted as part of the tool string. In FIG. 3A, the connection unit is fastened to the safety unit 8 in that the safety unit has a smaller inner diameter providing a flange which the connection unit 34 abuts—and the safety unit 8 thus hangs on the connection unit as the tool string is run in or pulled out of the well. The projectable elements of the anchoring section are projected to abut and engage the inner face of the safety unit when the tool string is in the well and preferably just before or just after the safety unit 8 abuts the restriction 32. Then the retrieving operation can be initiated.

In another embodiment as shown in FIG. 1, the projectable elements of the anchoring section are projected to abut and engage the inner face of the safety unit 8 before the tool string is run in to retrieve the plug, so that the tool string and the safety unit are firmly connected as the tool string and the safety unit are run in without use of other connection. As soon as the safety unit 8 abuts the restriction 32, the retrieving operation can be initiated.

When the abutment face 11 of the safety unit 8 rests against the restriction, the connection tool 2 is projected beyond the abutment face 11 along the longitudinal extension 10 of the tool string until the connection tool is connected to the plug or similar well component 30. When the second part 5 and thus the connection tool 2 and the plug are retracted so that the plug no longer engages the well tubular metal structure, the plug is not necessarily retracted into the first unit part 14 but may also just be arranged outside the safety unit 8 as the tool string and the safety unit are retracted from the well tubular metal structure 31.

In FIG. 1, each anchoring section has four projectable elements 7 arranged in the same cross-sectional plane along the longitudinal extension and perpendicular radially outwards, so that the projectable elements two and two project radially outwards in a direction opposite the other two projectable elements. In FIG. 3, the anchoring section has eight projectable elements 7 so that four projectable elements 7 are arranged in a first plane and the four other projectable elements 7 are in a second plane perpendicular to the first plane. The projectable elements 7 may be pistons moving in a cylinder in the tool body of the anchoring section and be projected radially outwards by pressurised fluid from the pump 23 (see FIG. 3).

In FIG. 2A, the safety unit 8 is a tubular sleeve having the same inner and outer diameter along the sleeve. In FIG. 2B, the safety unit 8 is also tubular and is divided into a plurality of arms 17, each arm having an end face 21 facing away from the top and constituting the abutment face. The inner diameter of the first unit part 14 is larger than the inner diameter of the second unit part 15, and the outer diameter of the first unit part 14 is larger than the outer diameter of the second unit part 15. In FIG. 2C, the safety unit 8 is a tubular having a square cross-sectional shape having an inscribed circle representing the inner diameter, and thus the inner diameter $ID_s$ of the first unit part 14 is larger than the inner diameter of the second unit part 15.

The tool string 1 may further comprise a cleaning tool 19 configured to eject or suck fluid to clean the profile 20 in the well component, as shown in FIG. 3. The cleaning tool is arranged between the connection tool, also called a GS pulling tool, and the force generator 3 and sucks or ejects fluid through a fluid channel 22 in the connection tool. The force generator is hydraulically driven by a pump 23 driven by a motor 24 which is powered by the wireline 12 through an electric section 25. The pump provides pressurised fluid to the anchoring section 6 and the force generator 3. The cleaning tool 19 is driven by electricity through the anchoring section 6 and the force generator 3. The cleaning tool may have a motor and a pump for suction or ejection of fluid. In another aspect of the invention, the cleaning tool is driven directly by the pump 23 providing pressurised fluid to the anchoring section 6 and the force generator 3. The cleaning tool 19 may also eject or suck fluid in through openings in the housing of the cleaning tool instead of having a fluid channel in the connection tool.

The safety unit is made of metal or similar material having the strength to withstand force generated by the force generator for pulling the plug without the plug bulging. The force generator is an axial force generator and the safety unit has to have sufficient strength in the axial direction along the longitudinal extension to withstand the high compression force.

The present invention also relates to a downhole system comprising the above mentioned retrieval system and a well tubular metal structure 31 in a borehole of a well, where the well tubular metal structure comprises a restriction 32 and a plug 30. The tool string of a retrieval system is arranged within the safety unit, and the tool string is fastened inside the safety unit by projecting the projectable element before the retrieval system is introduced into the well tubular metal structure until the abutment face rests against the restriction. Then the second part of the force generator is moved in relation to the first part until the connection tool engages the well component, and then the well component is pulled by retracting the second part of the force generator for retrieving the well component. The system may further comprise a detection unit for detecting a failure in retrieving the well component, and so that the connection tool can be released by providing a hammering force at the end face of the tool string.

The force generator may be a stroking tool which is a tool providing an axial force. The stroking tool comprises an electrical motor 24 for driving a pump 23. The pump pumps fluid into a piston housing in the force generator to move a piston acting therein. The piston is arranged on the stroker shaft 26 (see FIG. 3). The pump may pump fluid into the piston housing on one side and simultaneously suck fluid out on the other side of the piston to move either the stroker shaft or the housing of the stroking tool.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a driving unit such as a downhole tractor can be used to push the tool all the way into position in the well. The downhole tractor may also be used as the anchoring section. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A retrieval system for retrieving a well component from a well tubular metal structure having a restriction and a top, said retrieval system comprising:

a tool string having a longitudinal extension and comprising:

a connection tool configured to connect with the well component, a force generator having a first part and a second part which is connectable with the connection tool and movable in relation to the first part for providing the axial force in the longitudinal extension, and an anchoring section having at least one projectable element for anchoring the tool string, wherein the retrieval system further comprises a safety unit surrounding the tool string and having at least one wall and at least one abutment face configured to abut the restriction, said at least one projectable element abutting the wall of the safety unit in order to anchor the tool string in the safety unit.

2. The retrieval system according to claim 1, wherein the tool string is connected with the top via a wireline.

3. The retrieval system according to claim 1, wherein the safety unit has an inner diameter which is larger than an outer diameter of the tool string.

4. The retrieval system according to claim 3, wherein the inner diameter of the safety unit is less than 30% larger than the outer diameter of the connection tool.

5. The retrieval system according to claim 4, wherein the inner diameter of the safety unit is less than 20% larger than the outer diameter of the connection tool.

6. The retrieval system according to claim 4, wherein the inner diameter of the safety unit is less than 10% larger than the outer diameter of the connection tool.

7. The retrieval system according to claim 1, wherein the safety unit has a first unit part and a second unit part, the first unit part has the abutment face, and the first unit part has a larger inner diameter than an inner diameter of the second part, the at least one projectable element abutting the wall of the second unit part of the safety unit.

8. The retrieval system according to claim 1, wherein the safety unit has a first unit part and a second unit part, the first unit part has the abutment face, and the first unit part has a larger outer diameter than an outer diameter of the second part, the at least one projectable element abutting the wall of the second unit part of the safety unit.

9. The retrieval system according to claim 1, wherein the safety unit is made of metal.

10. The retrieval system according to claim 1, wherein the connection tool is projectable beyond the abutment face along the longitudinal extension.

11. The retrieval system according to claim 1, wherein the safety unit has a plurality of arms, each arm having an end face facing away from the top and constituting the abutment face.

12. The retrieval system according to claim 1, wherein the anchoring section has at least two projectable elements arranged in the same cross-sectional plane perpendicular to the longitudinal extension.

13. The retrieval system according to claim 1, wherein the tool string has a first end face facing the top and upon which end face a force may be applied to slightly move the tool string in relation to the safety unit to release the connection tool from the well component to be able to pull the tool string out of the well without retrieving the well component.

14. The retrieval system according to claim 1, wherein the tool string further comprises a cleaning tool configured to eject or suck fluid to clean a profile in the well component.

15. A downhole system comprising:

a well tubular metal structure in a borehole of a well, the well tubular metal structure comprising a restriction and a plug, and the retrieval system according to claim 1.

16. A downhole well component retrieval method, comprising:

arranging the tool string of the retrieval system according to claim 1 within the safety unit, anchoring the tool string inside the safety unit by projecting the projectable element, introducing the retrieval system into the well tubular metal structure until the abutment face rests against the restriction, moving the second part of the force generator in relation to the first part until the connection tool engages the well component, and pulling the well component by retracting the second part of the force generator for retrieving the well component.

17. The downhole well component retrieval method according to claim 16, comprising detecting a failure in retrieving the well component, and releasing the connection tool by providing a hammering force at the end face of the tool string.

* * * * *